United States Patent [19]

Axelrod

[11] 4,053,986

[45] Oct. 18, 1977

[54] METHOD OF PRODUCING PATCHWORK

[76] Inventor: Claire B. Axelrod, 100 E. Hartsdale Ave., Hartsdale, N.Y. 10530

[21] Appl. No.: 688,841

[22] Filed: May 21, 1976

[51] Int. Cl.[2] ..... A41H 3/00; D05B 97/12

[52] U.S. Cl. ..... 33/17 R; 33/12; 112/262; 428/40

[58] Field of Search ..... 33/11, 12, 17 R, 174 B, 33/174 G; 112/117, 218 R, 262; 428/40, 352

[56] References Cited

U.S. PATENT DOCUMENTS

| | | | |
|---|---|---|---|
| 2,251,647 | 8/1941 | Wartha | 428/352 |
| 2,411,328 | 11/1946 | MacNab | 33/12 |
| 3,432,376 | 3/1969 | Reed et al. | 428/40 |
| 3,898,943 | 8/1975 | Braden et al. | 112/262 |
| 3,929,068 | 12/1975 | Budden | 428/40 |

*Primary Examiner*—Richard E. Aegerter
*Assistant Examiner*—Richard R. Stearns
*Attorney, Agent, or Firm*—Milton Zucker

[57] ABSTRACT

Patchwork is produced by preparing patch shapes each consisting of a sheet of relatively rigid material such as thin cardboard, adhering said patches to the fabric to be used for the patchwork with a strippable adhesive, cutting out the patches with a seaming edge as needed around the individual patches, sewing the patches together while maintaining the rigid material in contact to protect the fabric against wrinkling and soiling during the operation, and then stripping the rigid material with the adhesive adhering thereto. The method is facilitated by laying out the design on the thin cardboard carrying the strippable adhesive and a protective strippable backing; the design can then be cut into individual patches or the cardboard can be cut without cutting the backing layer, so that the individual cardboard patch patterns can be stripped from the design sheet and adhered directly to the fabric.

4 Claims, 6 Drawing Figures

METHOD OF PRODUCING PATCHWORK

FIELD OF THE INVENTION

This invention relates to the making of patchwork, and is designed to produce better results in a convenient, relatively foolproof fashion.

BACKGROUND OF THE INVENTION

In the manufacture of patchwork, such as quilts and the like, it is conventional to produce a design on a sheet of thin paper or cardboard and then to cut out the individual patch patterns. Where paper is used for the original design, the individual paper patch patterns are then used to prepare cardboard patch patterns. The cardboard patch patterns are then traced onto the fabric with some marking device; the fabric patches are cut out with appropriate seam margins and sewn together, following the marking lines. The whole process is time-consuming, requires considerable skill, particularly in sewing along the marked lines, and generally produces a wrinkled, dirty patchwork fabric which requires laundering and ironing. In addition, it is difficult to determine where the fabric patches are to go unless they are marked for identification, and this marking must be removed from the fabric.

OBJECTS OF THE INVENTION

This invention aims to overcome the major difficulties in making patchwork, and enable unskilled persons to produce superior products.

STATEMENT OF THE INVENTION

In accordance with the instant invention, patchwork is produced in the following manner:

Patterns for the individual patches of a patchwork fabric are made from a relatively rigid material such as cardboard, said cardboard carrying an adhesive on one side thereof which is firmly attached to the cardboard but is readily strippable on its exposed surface. These pieces are adhered to the fabric which is used for the patchwork; the fabric is cut out with the necessary seam skirts; the pieces are sewn together through the seam skirts, using the edges of the cardboard as sewing guides. Finally, the cardboard and attached adhesive are stripped from the patchwork fabric. In addition to providing sewing edges which an unskilled person can follow easily, the cardboard protects the fabric from creasing and eliminates the necessity for marking the fabric, either with sewing lines or with indicia indicating the position of the particular patch in the composite.

The method can be made even simpler by providing a large cardboard backed with strippable adhesive and a protective sheet. A design can be drawn, printed or otherwise marked on the cardboard, with position indicia on the individual patch portions of the design, if desired. The separate patch patterns can then be cut out by the user. Most preferably, where a set design is being purchased, the cardboard is die-cut into pieces to produce a pattern consisting of a carrying sheet, a layer of strippable adhesive, and individual identified cardboard pieces which can be removed from the carrying sheet and used in the above defined process.

THE DRAWINGS

In the drawings which illustrate the method and product of this invention,

Figure 1:
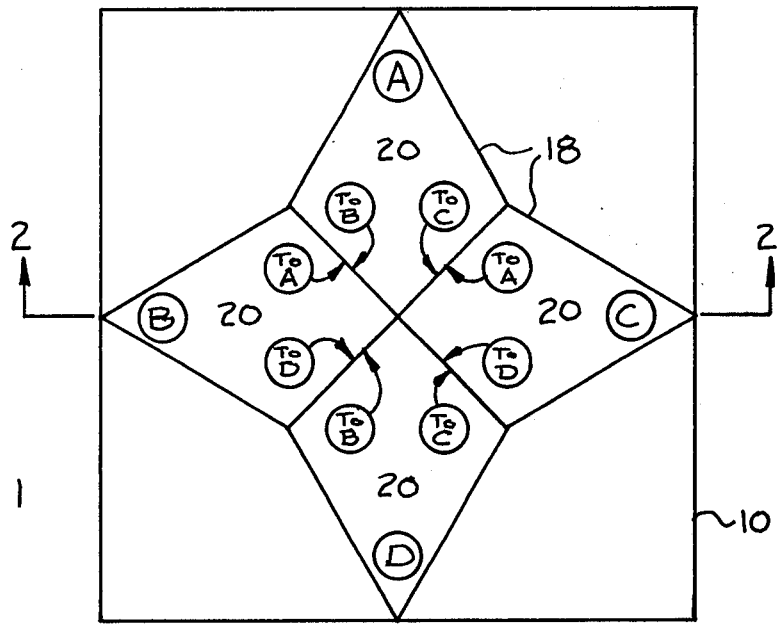
FIG. 1 is a plan view of a sheet of cardboard carrying a design for patchwork thereon.
Figure 2:
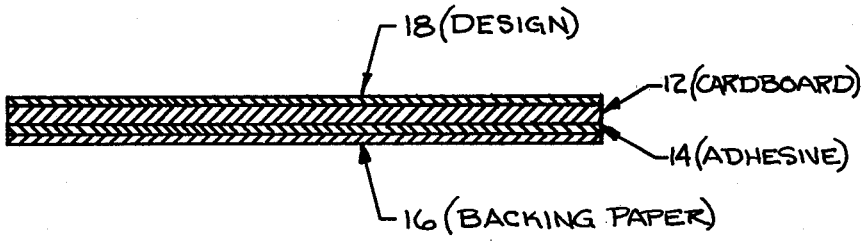
FIG. 2 is a section through line 2—2 of FIG. 1.

Referring to the drawings, a master stencil 10 is provided, comprising a sheet 12 of thin cardboard or other relatively stiff material (as compared to thin paper or to patchwork fabric) which carries a coating 14 of strippable adhesive on one side thereof, to which is adhered a thin protective backing sheet 16. This strippable adhesive adheres more strongly to the sheet 12 than the backing sheet 16 and is designed, in known fashion, to adhere more strongly to the sheet 12 than to the fabric used in making the patchwork, either intrinsically or by the use of a parting fluid which can be applied when it is desired to strip the stencil and adhesive from the fabric. The exposed surface of the stencil sheet 12 is designed to readily take impressions; a design 18 is applied to the said upper surface either freehand or by printing. The design divides the stencil up into individual patch stencils 20; preferably indicia, as shown circled in FIG. 4, are applied to identify the position of the individual pieces in the patchwork.

Figure 3:
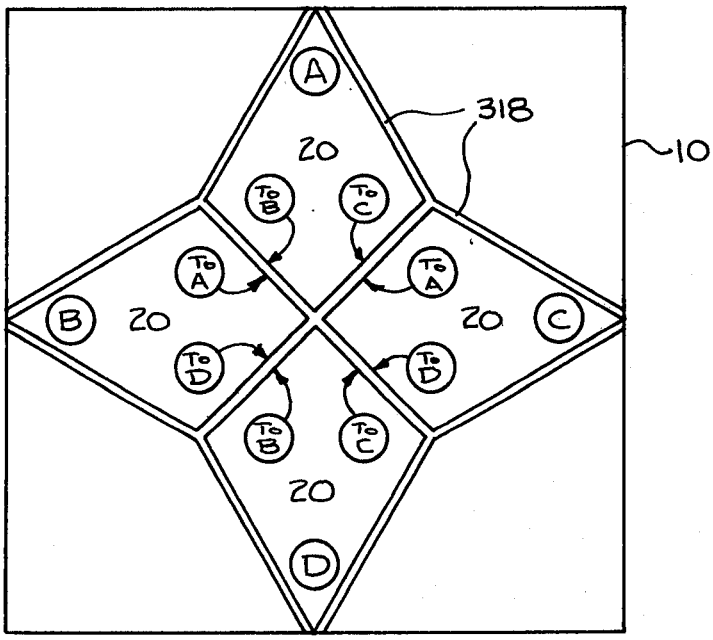
FIG. 3 is a plan view of the sheet of FIG. 1, die-cut to produce a master sheet in accordance with this invention.

In the preferred form of stencil sheet, shown in FIG. 3, the individual patch stencils 20 are actually cut apart by cuts 318 corresponding to the design lines 18 in FIG. 1. The individual patch patterns 20, carrying the adhesive film 14 on the surface opposite the top surface, can be removed from the backing sheet 16 and used in the process. The same result can be obtained, of course, by having the maker of the patchwork fabric cut up the composite master sheet 10 with a scissors, razor blade or other adequate cutting tool.

Figure 4:
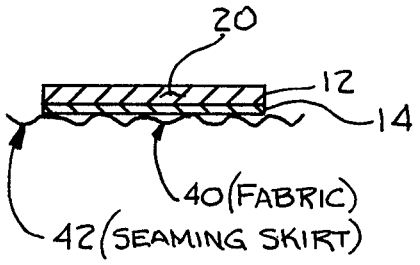
FIG. 4 is a section through an individual patch, adhered to the fabric and cut out with a seam skirt about it.

In either event, each individual patch pattern is adhered to the fabric to be used for the particular portion of the finished patchwork designed for that patch, and the fabric is cut out with enough border for a seam allowance, to produce individual patches as shown in FIG. 4, consisting of cardboard 12, adhesive layer 14 and fabric 40 having a seaming allowance or skirt 42.

While the pieces are being sewn together through the appropriate seam skirts, the cardboard sheet acts to put the pieces in the exact desired position, since the edges of the cardboard essentially line the pieces up properly with respect to one another. This eliminates the necessity for being able to sew along matching marked lines, where only the skill of the operator can ensure an adequate match.

Figure 5:
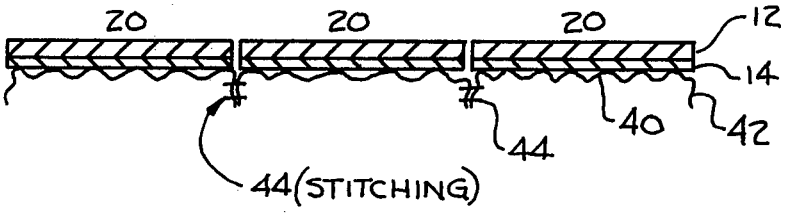
FIG. 5 is a section through a portion of a patchwork, before stripping of the cardboard.
Figure 6:
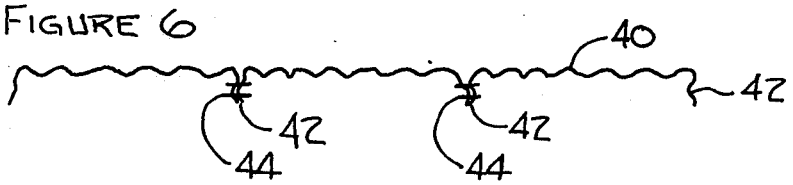
FIG. 6 is a section through the finished patchwork.

A portion of typical composite piece, after sewing, is shown in cross section in FIG. 5; the seam skirts 42 are held together by stitching 44. When the pieces of cardboard 12 are pulled away from the fabric, they carry the adhesive 14 with them, leaving the desired finished patchwork free of wrinkles put in by handling, free of directional markings, and relatively free of dirt accumulated during the process of cutting fabric and combining the fabric pieces.

While the method is illustrated for a relatively simple design, it is obviously not restricted thereto, and can be applied to quite complicated patterns.

Moreover, the method can be used by creative craftsmen, who can create their own designs on the master stencil sheet 10, and are skillful enough to handle the cutting of the individual patches. Note that a slight error in cutting does not affect the fit - it merely changes the design a trifle.

For unsophisticated persons, the use of a master stencil sheet in which the cardboard portion of the pattern is precut and mounted on a continuous backing sheet presents a means to produce acceptable patchwork products.

Obviously, the product and method herein described can be modified. For example, the patch patterns can be adhered to either the back or front of the fabric, and the seam skirts moved across or away from the pattern patches in sewing them together. Similar changes can be made in the specific embodiment of the invention herein described, without departing from the scope of the invention, as defined in the claims.

I claim:

1. The method of making patchwork which comprises (a) attaching to fabric to be used in making a desired patch a patch pattern comprising a sheet of material corresponding in shape to the desired patch, by means of a strippable adhesive which adheres more strongly to said material than to said fabric, said material being substantially stiffer than said fabric; (b) cutting said fabric to produce a patch piece sufficiently larger than the desired patch to provide a seam shirt; (c) positioning said patch next to another similarly prepared patch in the desired design sequence and sewing the seam skirts together while using the edges of said stiffer material to properly position said patches; and (d) thereafter stripping the said stiffer material and accompanying adhesive from the sewn patchwork.

2. The method of claim 1, in which said substantially stiffer material is cardboard.

3. The method of claim 1, in which each individual patch pattern carries indicia indicative of the position in the patchwork of the patch corresponding to said patch pattern.

4. The method of claim 1, in which the patchwork pattern is laid out on a sheet of said stiffer material and the individual patch patterns are cut out of said sheet.

* * * * *